US006729322B2

(12) United States Patent
Schavone

(10) Patent No.: US 6,729,322 B2
(45) Date of Patent: May 4, 2004

(54) COMPRESSED GAS-POWERED GUN SIMULATING THE RECOIL OF A CONVENTIONAL FIREARM

(76) Inventor: Mark Schavone, 5240 Sherwood Dr., Pittsburgh, PA (US) 15236

( * ) Notice: Subject to any disclaimer, the term of this patent is extended or adjusted under 35 U.S.C. 154(b) by 0 days.

(21) Appl. No.: 10/289,021

(22) Filed: Nov. 6, 2002

(65) Prior Publication Data

US 2003/0056778 A1 Mar. 27, 2003

Related U.S. Application Data

(62) Division of application No. 09/756,891, filed on Jan. 9, 2001.

(51) Int. Cl.[7] ..... F41B 11/02

(52) U.S. Cl. ..... 124/72; 124/52; 124/48; 89/33.03

(58) Field of Search ..... 124/72, 75, 74, 124/45, 48, 51.1, 52; 42/67; 89/155, 156, 157, 33.03

(56) References Cited

U.S. PATENT DOCUMENTS

| | | | | | |
|---|---|---|---|---|---|
| 2,151,521 | A | * | 3/1939 | Manville | 42/67 |
| 2,980,096 | A | * | 4/1961 | Merz | 124/74 |
| 3,049,977 | A | | 8/1962 | Reich | |
| 3,741,189 | A | * | 6/1973 | Kester et al. | 124/76 |
| 3,782,359 | A | * | 1/1974 | Kester et al. | 124/48 |
| 4,004,566 | A | * | 1/1977 | Fischer | 124/59 |
| 4,083,349 | A | | 4/1978 | Clifford | |
| 4,116,193 | A | | 9/1978 | Chiba | |
| 4,422,433 | A | * | 12/1983 | Milliman | 124/74 |
| 4,819,609 | A | | 4/1989 | Tippmann | |
| 4,986,251 | A | * | 1/1991 | Lilley | 124/67 |
| 5,063,905 | A | | 11/1991 | Farrell | |
| 5,150,701 | A | | 9/1992 | Wackrow et al. | |
| 5,341,790 | A | | 8/1994 | Ebert | |
| 5,400,536 | A | | 3/1995 | Milliman | |
| 5,462,042 | A | | 10/1995 | Greenwell | |
| 5,515,838 | A | | 5/1996 | Anderson | |
| 5,586,545 | A | | 12/1996 | McCaslin | |
| 5,592,931 | A | | 1/1997 | Johnson et al. | |
| 5,613,483 | A | | 3/1997 | Lukas et al. | |
| 5,660,159 | A | | 8/1997 | Clayton | |
| 5,680,853 | A | | 10/1997 | Clayton | |
| 5,709,199 | A | | 1/1998 | Johnson et al. | |
| 5,711,286 | A | | 1/1998 | Petrosyan et al. | |
| 5,760,328 | A | | 6/1998 | Robbins | |
| 5,771,875 | A | | 6/1998 | Sullivan | |
| 5,913,303 | A | | 6/1999 | Kotsiopoulos | |
| 6,470,871 | B2 | * | 10/2002 | Casas-Salva | 124/48 |

FOREIGN PATENT DOCUMENTS

| | | | | |
|---|---|---|---|---|
| GB | 2255399 | A | * 11/1992 | F41B/11/02 |

* cited by examiner

*Primary Examiner*—Charles T. Jordan
*Assistant Examiner*—John W. Zerr
(74) *Attorney, Agent, or Firm*—William F. Lang IV; Eckert Seamans Cherin & Mellott, LLC

(57) ABSTRACT

A compressed gas powered gun provides recoil simulating the recoil of a gun firing gunpowder propelled projectiles. The valve assembly provides both consistent shot to shot pressure, and rearward gas pressure for generating recoil. Preferred embodiments of the compressed gas powered gun may include a system for adjusting the amount of recoil provided. A trigger mechanism permitting semi-automatic operation, or full automatic operation at a user selectable cyclic rate, is provided. The air gun provides consistent gas pressure behind the projectile from shot to shot. A magazine and magazine indexing system for loading projectiles into the firing chamber in a manner contributing to the accuracy of the air gun is also provided.

16 Claims, 18 Drawing Sheets

COMPRESSED GAS-POWERED GUN SIMULATING THE RECOIL OF A CONVENTIONAL FIREARM

CROSS REFERENCE TO RELATED APPLICATION

This application is a divisional of U.S. patent application Ser. No. 09/756,891, entitled, "Compressed Gas-Powered Gun Simulating The Recoil of a Conventional Firearm," filed Jan. 9, 2001.

BACKGROUND OF THE INVENTION

1. Field of the Invention

This application relates to compressed gas powered guns. More specifically, the invention relates to training guns duplicating various characteristics of guns firing gunpowder propelled projectiles.

2. Description of the Related Art

Guns firing projectiles propelled by compressed air or gas are commonly used for recreational target shooting or as training devices for teaching the skills necessary to properly shoot guns firing gunpowder propelled projectiles. Ammunition for air guns is significantly less expensive than gunpowder propelled ammunition. A typical gas powered projectile has significantly lower velocity and energy than a gunpowder propelled projectile, making it much easier to locate a safe place to shoot an air gun, and much less expensive to construct a suitable backstop. Additionally, the low velocity and energy of air powered projectiles makes air guns significantly less useful as weapons than guns firing gunpowder propelled projectiles. Lack of usefulness as a weapon is an important factor in making air guns available in regions where national or local governments regulate firing gunpowder propelled projectiles (firearms).

To be an effective training tool, an air gun must duplicate the characteristics of a firearm as closely as possible. These characteristics include size, weight, grip configuration, trigger reach, type of sights, level of accuracy, method of reloading, method of operation, location of controls, operation of controls, weight of trigger pull, length of trigger pull, and recoil. The usefulness of a gas powered gun as a training tool is limited to the extent that any of the above listed characteristics cannot be accurately duplicated.

Presently available air guns increasingly tend to have an exterior configuration resembling that of a gun firing a powder propelled projectile. Presently available air guns may be used in a semi-automatic (one shot per pull of the trigger) or very rarely full automatic (more than one shot per pull of the trigger) mode of fire, although the cyclic rate of full automatic fire typically does not duplicate the cyclic rate of a full automatic firearm firing a projectile powered by gunpowder. The vast majority of presently available airguns which are advertised as being semiautomatic are actually nothing more than double-action revolver mechanisms disguised within an outer housing that simply looks like a semiautomatic gun. However, because they are true double-action mechanisms, the weight of trigger pull is much heavier than the weight of trigger pull of the present invention, which has a true single-action trigger. Presently available air guns have also been designed to simulate the trigger pull and reloading of guns firing gunpowder propelled projectiles.

Presently available air guns do not duplicate the recoil of a gun firing a powder propelled projectile. The inability to get a trainee accustomed to the recoil generated by conventional firearms is one of the greatest disadvantages in the use of air guns as training tools. Additionally, although presently available air guns can be made extremely accurate, variations in gas pressure can cause differences in shot placement from shot to shot, or from the beginning of a gas cartridge to the end. Further, duplication of the cyclic rate of a conventional firearm within an air gun would enable a trainee to learn how to properly depress the trigger to fire short bursts of approximately three shots in full automatic mode of fire using an air gun. Because recoil is significantly more difficult to control during full automatic fire than during semi-automatic fire, an air gun simulating both recoil and the cyclic rate of a conventional firearm would be particularly useful as a training tool.

Accordingly, there is a need for an air powered gun duplicating the recoil of a conventional firearm. Additionally, there is a need for an air powered gun maintaining a consistent compressed gas pressure behind the projectile from shot to shot, thereby maintaining a constant velocity, energy, and point of impact for each projectile. Further, there is a need for an air gun duplicating the full automatic cyclic rate of a conventional full automatic firearm. There is also a need to combine these characteristics into an air gun that is not particularly useful as a weapon, thereby facilitating safe use by inexperienced trainees, making training facilities easier and more economical to construct, lowering the cost of ammunition and training, reducing noise levels, and broadening the legality of ownership.

SUMMARY OF THE INVENTION

The preferred embodiment of the invention is an air or gas powered gun providing a recoil similar to that of a gun firing a powder propelled projectile. The compressed gas powered gun includes an improved magazine and magazine indexing system, contributing to the accuracy of the gun. The compressed gas powered gun preferably also duplicates many other features of a conventional firearm, for example, the sights, the positioning of the controls, and method of operation. One preferred embodiment simulates the characteristics of an AR-15 or M-16 rifle, although the invention can easily be applied to simulate the characteristics of other conventional firearms.

The operation of a compressed gas powered gun of the present invention is controlled by the combination of a trigger assembly, bolt, buffer assembly and valve. Preferred embodiments will be capable of semi-automatic fire, full automatic fire at a low cyclic rate, and full automatic fire at a high cyclic rate. One of the two full automatic cyclic rates preferably approximately duplicates the cyclic rate of a conventional automatic rifle, for example, an M-16 rifle.

The trigger assembly includes a trigger having a finger-engaging portion and a selector-engaging portion, a selector switch, a trigger bar, a sear trip, and a sear. The selector switch will preferably by cylindrical, having three bearing surfaces corresponding to safe, semi-automatic fire, and full automatic fire at a low cyclic rate, and a channel corresponding to full automatic fire at a high cyclic rate. These surfaces and channel of the selector bear against the selector engaging portion of the trigger, permitting little or no trigger movements if safe is selected, and increasing trigger movement for semi-automatic fire, low cyclic rate full automatic fire, and high cyclic rate full automatic fire, respectively. The sear is mounted on a sliding pivot, and is spring-biased towards a rearward position. The sear has a forward end for engaging the sear trip, and a rear end for engaging the bolt.

The bolt preferably contains a floating mass, and reciprocates between a forward position and a rearward position. Although the bolt is spring-biased towards its forward position, the bolt will typically be held in its rearward position by the sear except during firing.

The valve assembly includes a reciprocating housing containing a stationary forward valve poppet, a sliding rear valve poppet, and a spring between the front and rear valve poppets. The spring pushes the rear valve poppet rearward, causing the rear poppet to bear against the housing, thereby closing the rear valve and pushing the housing rearward. Pushing the housing rearward causes the housing to bear against the front valve poppet, thereby closing the front valve.

Before the trigger is pulled, the trigger is in its forwardmost position, the bolt is held to the rear by its engagement with the sear, and the sear, although spring-biased rearward, is pushed towards its forwardmost position by the bolt. Pulling the trigger causes the trigger bar to move rearward, pivoting the sear trip upward. The upward movement of the sear trip pushes upward on the forward end of the sear, causing the rearward end of the sear to move down. The bolt is then free to travel forward, where the bolt strikes the rear valve, thereby moving the rear valve relative to the housing and opening the rear valve. Air pressure between the O-ring on the bolt face and the O-ring on the rear of the valve housing causes the housing to move forward, thereby opening the forward valve. Opening the forward valve dispenses pressurized gas to a position directly behind the projectile, causing the projectile to exit the barrel. Opening the rear valve supplies air pressure to the bolt face, thereby causing the bolt to return to its rearward position. If semi-automatic fire is selected, the limited movement of the sear trip, combined with the rearward spring-bias on the sear, causes the sear to move backwards on its pivot to a position where the sear trip can no longer apply upward pressure to the forward portion of the sear. The rear portion of the sear therefore pivots upward. The bolt will be propelled rearward to a point slightly behind the position wherein it engages the sear. As the bolt returns forward, the sear, which is no longer held in place by the sear trip, will engage the bolt, preventing further forward movement. From this position of the components, the trigger must be released before it can be pulled to fire another shot.

If full automatic fire at a slow cyclic rate is selected, the trigger may be pulled slightly farther to the rear before it engages the selector, thereby causing the sear trip to pivot slightly higher. Whereas the upper bearing surface of the sear trip pushes the sear up to initially release the bolt, here, the lower end bearing surface of the sear trip pushes the sear up sufficiently so that, when the bolt catches the sear, there is only about $1/32^{nd}$ inch of engagement between the sear and bolt. The floating mass bolt is thereby momentarily held in its rearward position by the sear, which cams forward off the sear trip as the forward motion of the bolt pushes the sear from its rearward position to its forward position.

If full automatic fire at a high cyclic rate is selected, the trigger is allowed to travel to its maximum rearward position. The sear trip is thereby pivoted upward to its maximum extent, causing the lower end bearing surface of the sear trip to push the sear completely out of the way of the bolt. Therefore, as soon as the spring behind the bolt driver overcomes the rearward momentum of the bolt, the bolt will simply return forward and again actuate the valve.

A compressed gas powered gun of the present invention preferably includes a magazine and magazine indexing assembly configured to facilitate precise alignment of the firing chambers with the barrel. A preferred embodiment of the magazine is a cylinder. The term "cylinder" as used herein does not necessarily mean a perfect geometrical cylinder, but is used to denote a generally cylindrical magazine wherein a plurality of firing chambers are located around its circumference, as known to those skilled in the art of revolvers. A preferred cylinder will have six chambers, although this number may vary. The exterior surface of the cylinder will preferably include a plurality of flutes, with the flutes located between the chambers, and with an equal number of chambers and flutes. One preferred embodiment of the cylinder aligns the chamber with the barrel in the three o'clock position when viewed from the rear or the nine o'clock position when viewed from the front. A spring-biased bearing preferably engages the flutes, thereby precisely aligning the cylinder with the barrel. A preferred bearing will have a larger radius than the radius of the flutes, thereby maximizing the precision with which the chamber and barrel may be aligned. This arrangement permits the barrel and chamber to be aligned with such precision that a forcing cone is not needed at the breach of the barrel.

Indexing of the cylinder is controlled by the forward and backward movements of the bolt. A spring-biased pawl mounted on a pawl carrier is located directly behind the cylinder. The pawl carrier reciprocates between a left most position and a right most position, with the left most position corresponding to the engagement of the pawl with one chamber of the cylinder, and the right most position corresponding to engagement of the pawl with another chamber of the cylinder. An operating rod extends forward from the bolt, overlapping the pawl carrier. The bottom surface of the operating rod includes an angled slot, dimensioned and configured to guide an upwardly projecting pin on the pawl carrier. With the bolt in its rear most position, the pawl carrier pin is located in the forwardmost portion of the operating rod's angled slot. The pawl carrier and pawl are therefore in their right side position. The pawl is spring-biased forward to engage the chamber in the one o'clock position when viewed from the rear, or the eleven o'clock position when viewed from the front. As the operating rod moves forward due to forward travel of the bolt, the pawl carrier is moved from its right side position to its left side position. The left side of the pawl includes a ramped surface which permits the pawl to be pushed rearward by the cylinder wall, against the bias of the spring, allowing the pawl to move from the top right side chamber to the top left side chamber. When the bolt returns to its rearward position, the pawl and pawl carrier are moved from their left side position to their right side position. The right side of the pawl is parallel to the inside of the cylinder wall, so that movement of the pawl from left to right will cause the cylinder to index in a clockwise direction when viewed from the rear, or a counterclockwise direction when viewed from the front. The bearing will be biased out of the current flute, and will bear against the next flute at the completion of indexing, thereby properly aligning the next firing chamber with the barrel.

Another preferred embodiment includes a tubular magazine in addition to the cylinder. The tubular magazine is aligned with one chamber of the cylinder whenever another chamber of the cylinder is aligned with the barrel. The tubular magazine includes a spring-biases follower for pushing projectiles rearward into the cylinder. Whenever the cylinder is indexed, another projectile will thereby be pushed into an empty chamber of the cylinder as that chamber is aligned with the tubular magazine.

If no tubular magazine is present, or if use of only the cylinder is desired, a preferred method of reloading the compressed gas powered gun is to remove the cylinder, place a single pellet into each chamber, and then replace the cylinder. If the tubular magazine is used, a preferred method of loading the compressed gas powered gun includes retracting the follower using a finger tab secured to the follower and extending outside the gun, opening a loading gate, and pouring projectiles into the tubular magazine. Preferred projectiles for use of a tubular magazine include spherical pellets. Preferred projectiles for use with the cylinder alone include spherical pellets or conventional air gun pellets.

A compressed gas powered gun of the present invention uses a recoiled buffer system for biasing the bolt forward, and for providing a recoil for the shooter. A preferred buffer system includes a floating mass bolt driver, and an air resistance bolt driver, with a spring disposed therebetween. This assembly is located in a tube within the air gun's shoulder stock, which is preferably a cylindrical tube. The buffer assembly may be oriented so that either the air resistance bolt driver or the floating mass bolt driver is positioned directly behind the bolt, with the other bolt driver placed at the rear of the stock. The forward bolt driver will thereby abut the rear of the bolt, pushing the bolt forward.

If the air resistance bolt driver is positioned directly behind the bolt, light recoil results. The air resistance bolt driver has less mass than the floating mass bolt driver, resulting in less mass reciprocating back and forth. Additionally, the air resistance bolt driver will trap air behind it as it reciprocates, thereby slowing travel of the reciprocating mass. Conversely, positioning the floating mass bolt driver behind the bolt results in heavier recoil, due to the increased reciprocating mass and the lack of the ability of the floating mass bolt driver to trap air. The shooter may therefore select the desired level of recoil to correspond with the recoil of the conventional firearm the shooter wishes to simulate.

It is therefore an aspect of the present invention to provide a compressed gas powered gun simulating the recoil of a conventional firearm.

It is another aspect of the present invention to provide a compressed gas powered gun wherein the level of recoil provided to the shooter may be selected by the shooter.

It is further aspect of the present invention to provide a compressed gas powered gun capable of simulating the operation of a conventional firearm.

It is another aspect of the present invention to provide a compressed gas powered gun capable of both semi-automatic and full automatic operation.

It is a further aspect of the present invention to provide a compressed gas powered gun wherein different cyclic rates of full automatic fire may be utilized.

It is another aspect of the present invention to provide a compressed gas powered gun utilizing a magazine and magazine indexing system providing precise alignment of the firing chambers with the barrel.

It is a further aspect of the present invention to provide a compressed gas powered gun capable of utilizing multiple types of projectiles.

It is another aspect of the present invention to provide a compressed gas powered gun for providing training that accurately simulates shooting a conventional firearm.

It is a further aspect of the present invention to provide a compressed gas powered gun that may be legally owned and utilized in locations where conventional firearms are heavily restricted.

Theses and other aspects of the present invention will become apparent through the following description and drawings.

BRIEF DESCRIPTION OF THE DRAWINGS

Like reference numbers denote like elements throughout the drawings.

DETAILED DESCRIPTION OF THE PREFERRED EMBODIMENTS

Figure 1:
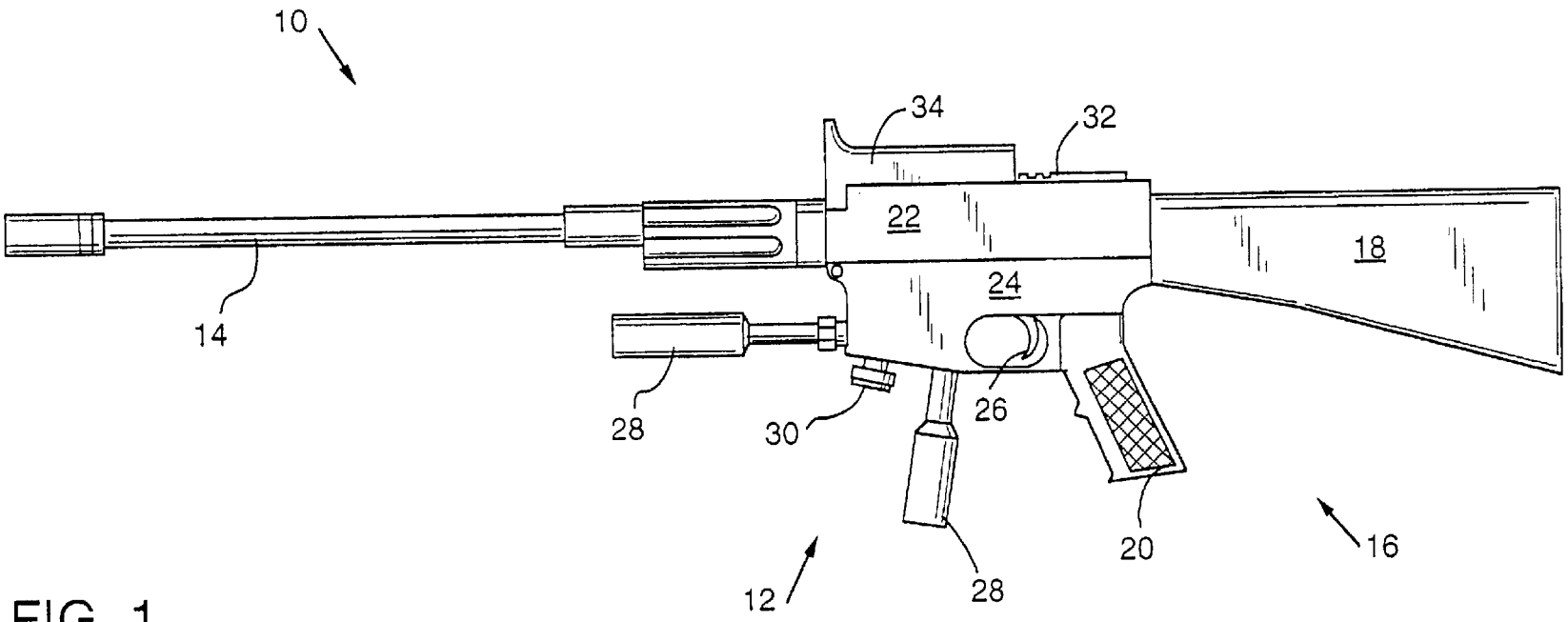
FIG. 1 is a side view of a compressed gas powered gun according to the present invention.

The preferred embodiments of the present invention is a compressed gas powered gun that simulates the recoil of a conventional firearm discharging a powder propelled projectile. Referring to FIG. 1, a preferred embodiment of the compressed gas powered gun 10 is illustrated. The illustrated embodiments of the compressed gas powered gun simulates an AR-15 or M-16 rifle. The rifle 10 includes an action portion 12, a barrel 14, and a stock portion 16. The stock portion 16 includes a shoulder stock 18 and a pistol grip 20. The action portion 12 includes an upper receiver portion 22, to which the barrel 14 is secured, and a lower receiver portion 24, to which the shoulder stock 18 and pistol grip 20 are secured. A trigger 26 is located just ahead of the pistol grip 20 within the lower receiver portion 24. The lower receiver portion 24 also includes at least one compressed gas container 28, and may include a pressure gauge 30. The upper receiver portion 22 includes a sight mounting rail 32 on its top surface, upon which the electronic dot sight 34 is illustrated. Any conventional sight may be substituted for the electronic dot sight 34, including telescopic sights, or standard post front, aperture rear iron sights.

Figure 2:
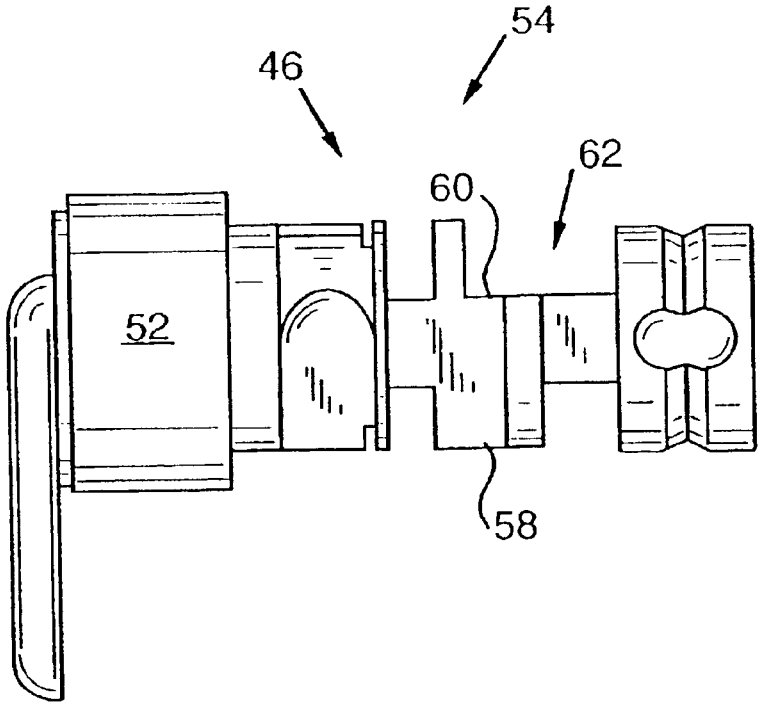
FIG. 2 is a side view of a four-position selector switch according to the present invention.
Figure 3:
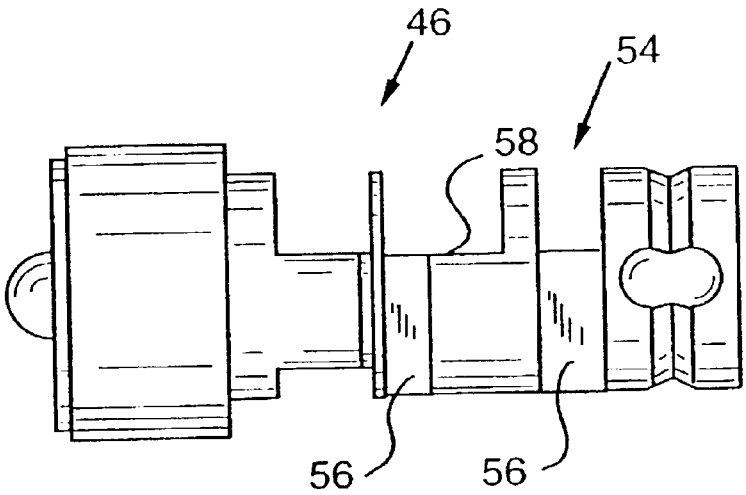
FIG. 3 is a side view of a four-position selector switch according to the present invention, rotated 90° from the position of FIG. 2.
Figure 4:
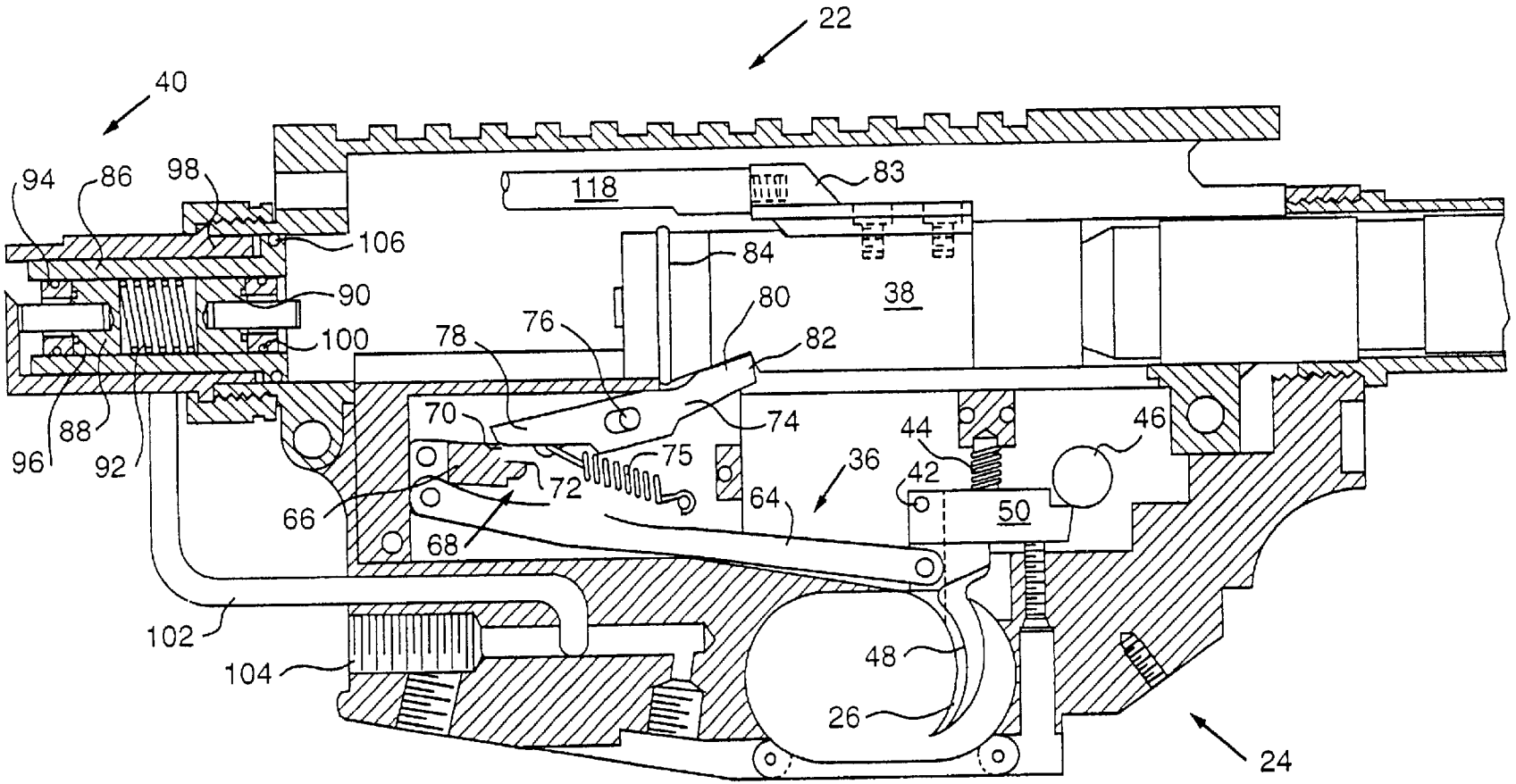
FIG. 4 is a side cross-sectional view of a trigger assembly, valve assembly and bolt of a gas powered gun according to the preset invention, showing the position of the components before the trigger is pulled.

Referring to FIGS. 2–8, 17–18, and 22, the trigger assembly 36, bolts 38, and valve assembly 40 are illustrated. The trigger 26 is pivotally secured within the lower receiver portion 24 at pivot 42, and is biased towards its forward position by the trigger return spring 44. The trigger 26 includes a finger-engaging portion 48, and a selector-engaging portion 50. The selector-engaging portion 50 is dimensioned and configured to abut a selector 46 when the trigger 26 is pulled rearward. The selector 46 is best illustrated in FIGS. 2–3. The selector 46 includes an actuator 52 for permitting the shooter to rotate the selector 46 as explained below, and a trigger-engaging portion 54. The trigger-engaging portion 54 includes a first surface 56, corresponding to safe. A second surface 58 of the trigger-engaging portion 54 corresponds to semi-automatic fire. A third surface 60 of the trigger-engaging portion 54 corresponds to full automatic fire at a slow cyclic rate. This surface 60 is different from selectors used in firearms in that it is cut to a different geometry to be used as a cam stop for the trigger as opposed to a surface that controls disconnectors. It is therefore sufficiently different that it cannot be used in a firearm. Lastly, the trigger-engaging portion 54 defines a channel 62, corresponding to full automatic fire at a high cyclic rate. Referring back to FIGS. 4–8, the trigger 26 is pivotally secured to one end of a trigger bar 64, with the other end of the trigger bar 64 secured to a sear trip 66. The sear trip 66 includes a sear-engaging end 68, having an upper radius surface 70 and a lower radius surface 72. The sear 74 is pivotally secured within the lower housing 24 by the sliding pivot 76. The sear 74 includes a front end 78, dimensioned and configured to engage the sear trip 66, and a back end 80, dimensioned and configured to mate with a notch 82 defined within the bolt 38. A spring 75 biases the sear rearward, and the front end 78 downward. The bolt 38 contains floating mass 39, and includes a bolt key 83, dimensioned and configured to secure an operating rod (described below). A spring-biased bolt driver is located directly behind the bolt 38, as will also be explained below. The forward portion of the bolt preferably includes an O-ring 84 around its circumference.

The valve assembly 40 includes a housing 86, a forward valve 88, a rear valve 90, and a spring 92 between the forward valve 88 and rear valve 90. The front valve 88 is stationary. The housing 86 reciprocates between a forward position and a rearward position, with the inward flange 94 bearing against the front O-ring 96 to close the front valve 88 when the housing 86 is in its rearward position, and with the forward position of the housing 86 corresponding to the front valve being opened. The rear valve 90 reciprocates within the housing 86, with the rearward position of the valve 90 bringing the O-ring 98 against the housing's rear flange 100, thereby closing the rear valve. When the rear valve 90 moves forward relative to the housing 86, the rear valve 90 is opened. Compressed gas is supplied to the valve assembly 40 through the hose 102, connected between the valve 40 and the compressed gas channels 104 within the lower receiver 24. The compressed gas container 28 is secured to the compressed gas channels 104, thereby supplying compressed gas through the channels 104, hose 102 to the valve assembly 40. The rear end of the housing 86 also includes an O-ring 106.

Referring to FIGS. 9–14 and 16–17, a preferred embodiment of a magazine assembly 108 is illustrated. A preferred magazine is a cylinder 110, located immediately in front of the valve assembly 40, and directly behind the barrel 14. A cylinder is defined herein as a rotary magazine similar to that used in a revolver wherein a plurality of firing chambers are arranged around the circumference, and is not necessarily a perfect geometrical cylinder. Cylinder 110 rotates about a central axis (not shown, and well known in the art) and has a plurality of chambers 112, parallel to the central axis, and bored around the circumference. A preferred and suggested number of firing chambers 112 is six, although a different number may easily be used. The firing chambers 112 are each dimensioned and configured to receive one projectile, with the projectile positioned so that compressed air from the valve 88 will be positioned behind the projectile. The cylinder 110 also includes a plurality of flutes 114 around its circumference, with the flutes 114 located between the chambers 112, and equal in number to the number of chambers 112. A spring-biased bearing 116 preferably engages the flutes 114 to precisely align a chamber 112 of the cylinder 110 with the barrel 14. The bearing 116 preferably has a radius larger than the radius of the flutes 114, thereby facilitating more precise alignment.

Indexing of the cylinder 110 is controlled by movement of the bolt 38. The bolt key 83 secures an operating rod 118 to the bolt 30, so that as the bolt 38 reciprocates, the operating rod 118 will reciprocate with the bolt 38. The operating rod 118, shown in phantom for maximum clarity, defines an angled slot 120 along its bottom surface. A pawl assembly 122 is located directly behind the cylinder 110. The pawl assembly 122 includes a pawl carrier 124, having a spring-biased pawl 126. The pawl carrier 124 includes a pin 128, dimensioned and configured to fit within the angled slot 120 of the operating rod 118. The pawl 126 includes a reloading tab 130, and a cylinder-engaging end 132 having a pusher surface 134 and ramp surface 136. The cylinder-engaging end 132 is biased into one of chambers 112 by the spring 138. The magazine assembly 108 may also include a magazine tube 140, aligned with one of the chambers 112 of the cylinder 110. The magazine tube 140 is dimensioned and configured to contain a plurality of spherical projectiles. The magazine tube 140 includes a spring-biased follower 142, and has a loading gate 144 at its forward end. In one preferred embodiment, the chamber 112 in the three o'clock position when viewed from the rear is aligned with the barrel 14, and the chamber in the eleven o'clock position when viewed from the rear is aligned with the magazine tube 140. Additionally, in one preferred embodiment, the pawl 126 acts on the chambers in the eleven o'clock and one o'clock positions when viewed from the rear, as will be explained below.

Figure 15:
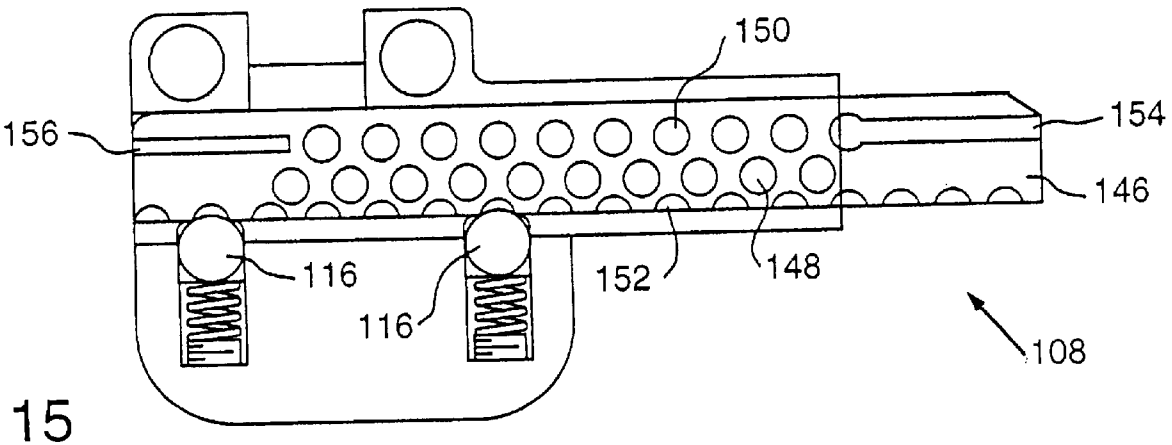
FIG. 15 is a front cross-sectional view of an additional alternative embodiment of a magazine for a gas-powered gun of the present invention.
Figure 16:
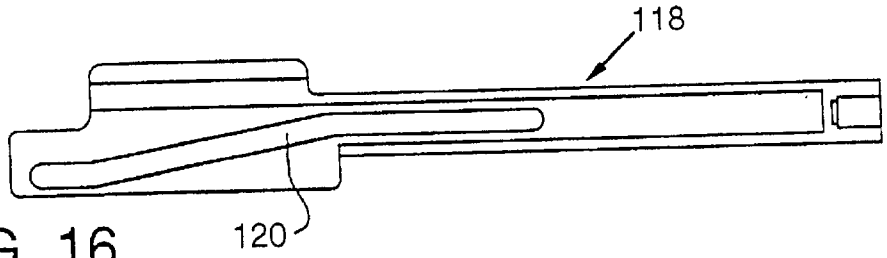
FIG. 16 is a bottom view of an operating rod for a gas-powered gun according to the present invention.
Figure 17:
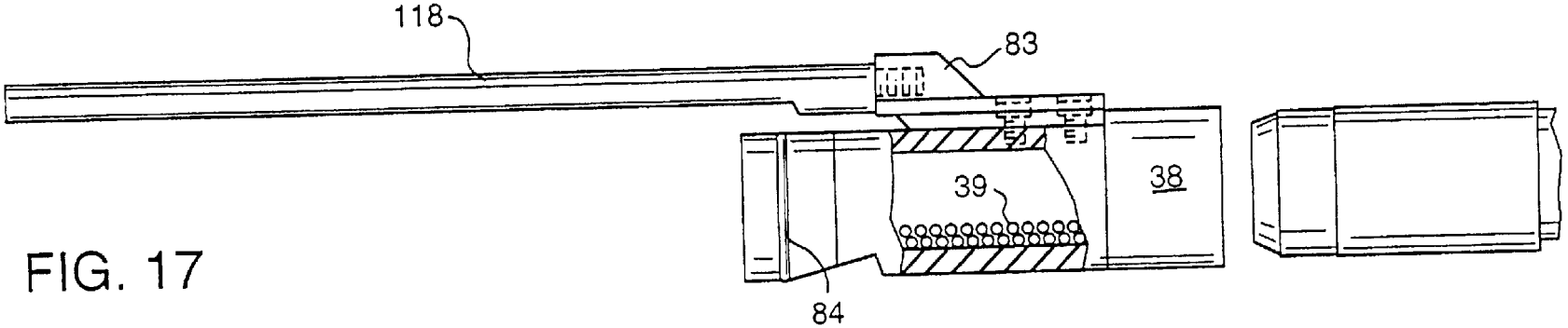
FIG. 17 is a side partially cut away view of a bolt, operating rod, and front portion of a bolt driver for a gas powered gun according to the present invention.
Figure 18:
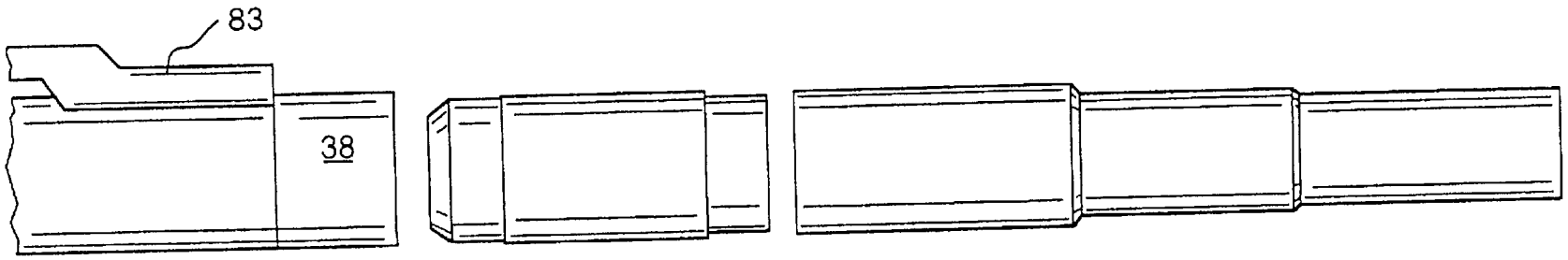
FIG. 18 is a side view of a bolt and bolt driver for a gas powered gun according to the present invention.
Figure 19:
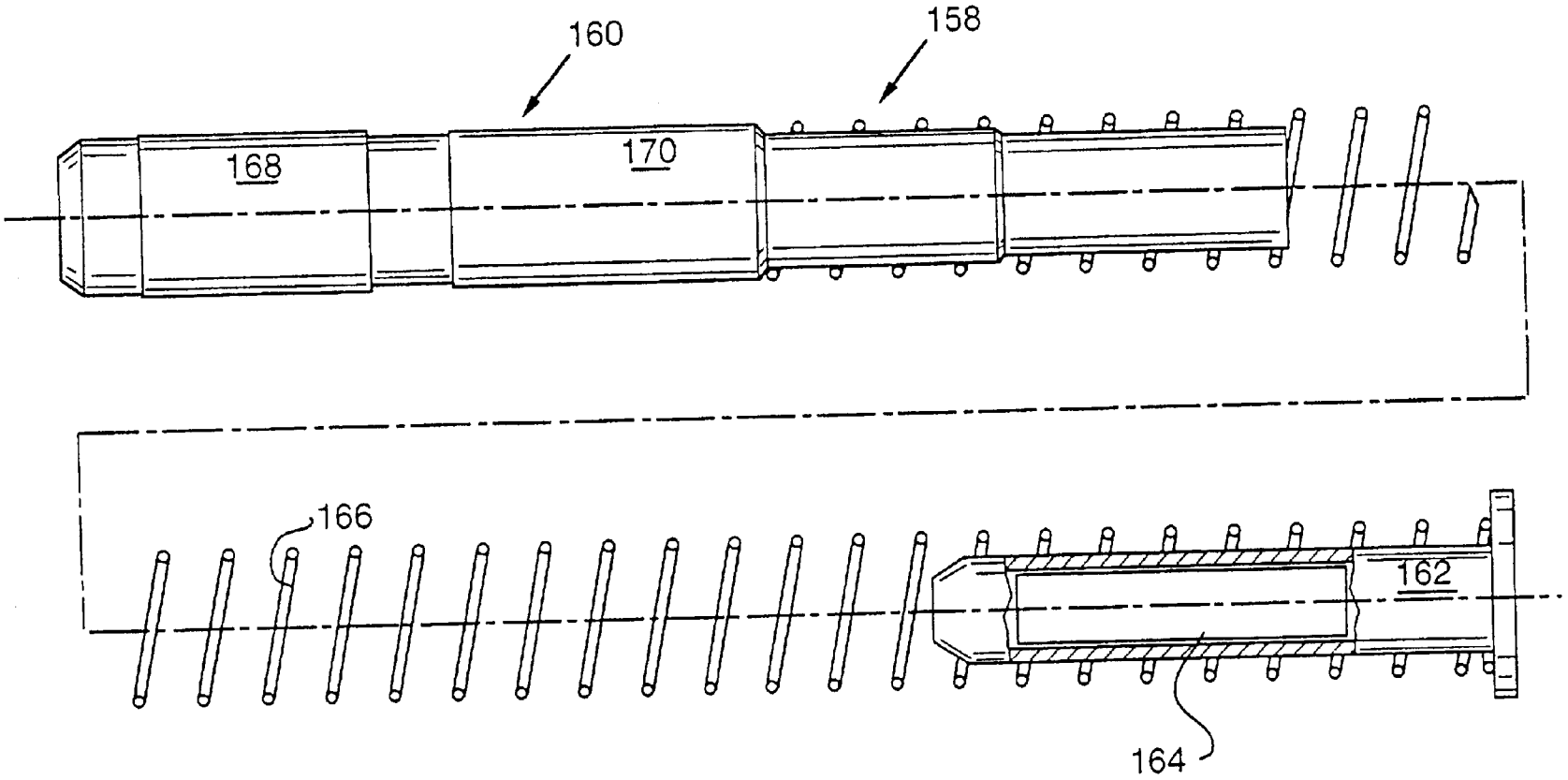
FIG. 19 is a side view of an air resistance bolt driver and floating mass bolt driver for a gas-powered gun according to the present invention.
Figure 20:
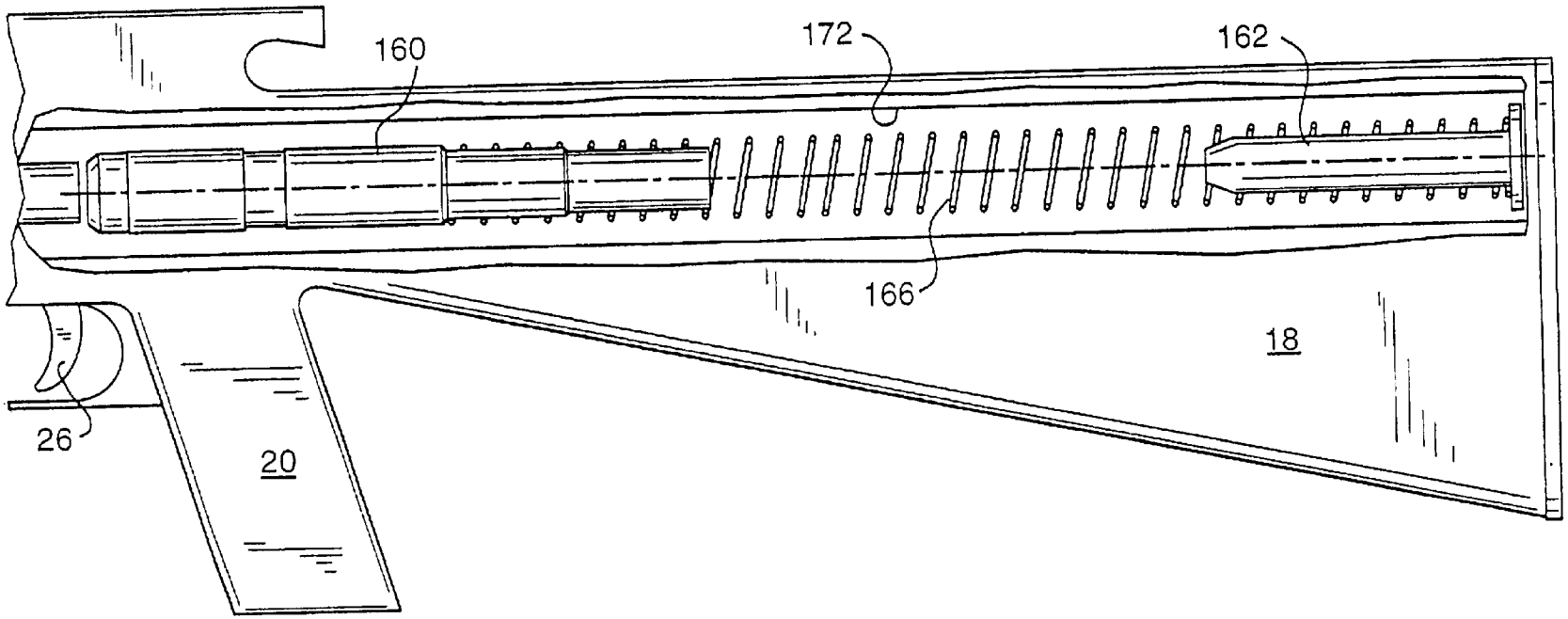
FIG. 20 is a side cut away view of a buffer assembly for a gas powered gun according to the present invention, showing the components configured for low recoil.
Figure 21:
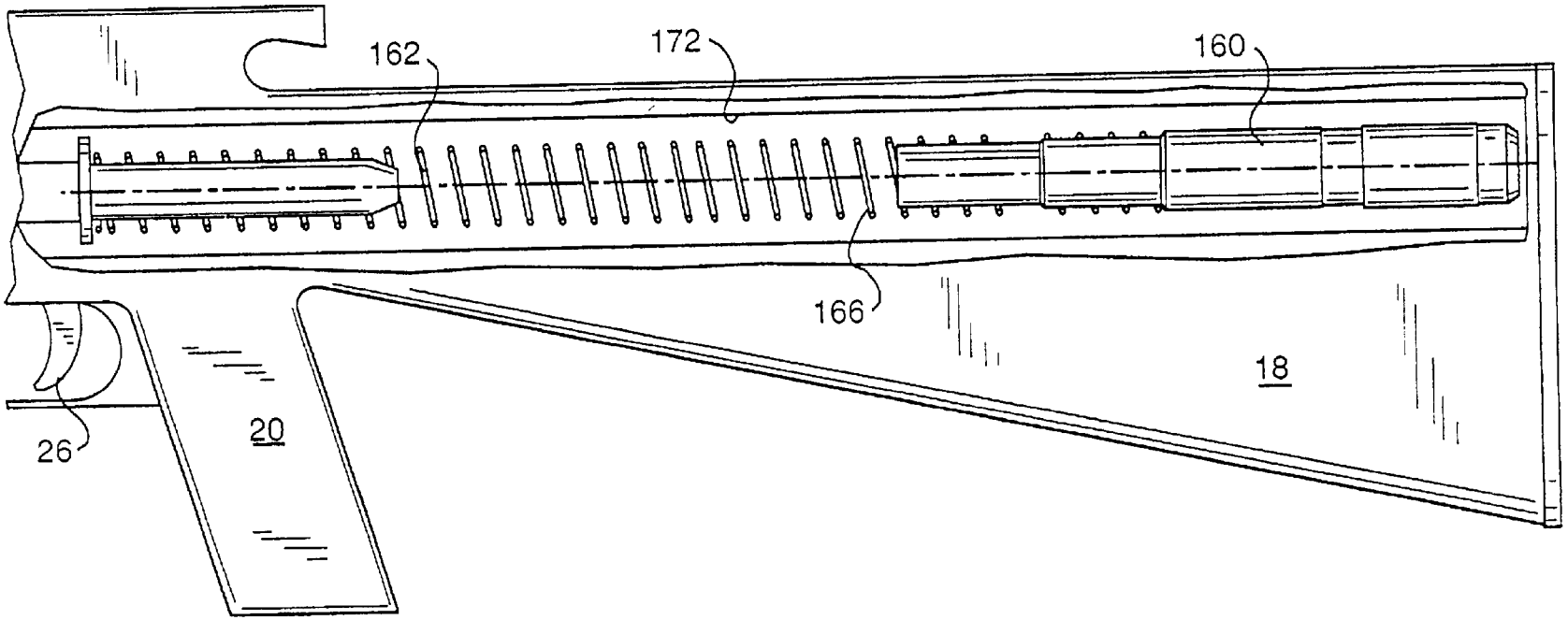
FIG. 21 is a side cut away view of a buffer assembly for a gas-powered gun according to the present invention, showing the components configure for high recoil.

An alternative embodiment of a magazine assembly 108 is illustrated in FIG. 15. The cylinder 110 has been replaced by an elongated bar 146, having a plurality of chambers 148, indexing holes 150, and flutes 152 along its bottom surface. At least one spring-biased bearing 116 engages a flute 152 to align the chambers 148 with the barrel 14. A pair of slots 154, 156 permit the rod 146 to be inserted into the rifle 10 by accommodating the pawl 126. As will be seen below, indexing of the magazine 146 is very similar to the indexing of the cylinder 110.

Referring to FIGS. 18–21, the buffer system 158 is illustrated. A preferred buffer system 158 includes an air piston bolt driver 160, a floating mass bolt driver 162 having a floating mass 164 therein, and a spring 166 disposed therebetween. The air piston bolt driver may preferably be made of two pieces, a forward portion 168 and rear portion 170. The buffer system 158 is located directly behind the bolt 38, and is housed within a buffer tube 172 within the shoulder stock 18. Depending on the length of the buffer tube 172, the forward portion 168 of the air resistance bolt driver may either be attached or removed from the rear portion 170 of the air piston bolt driver 158.

Figure 22:
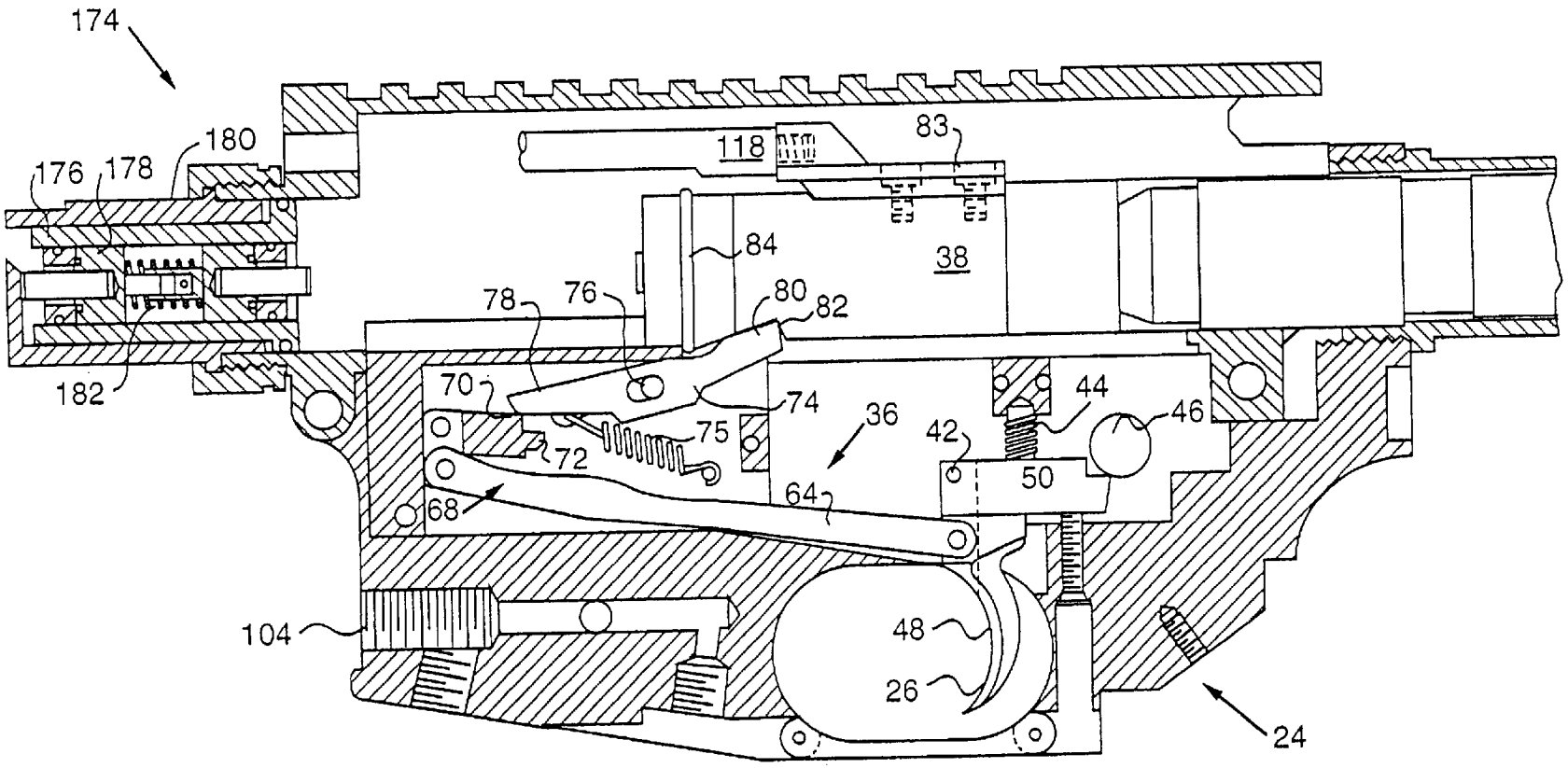
FIG. 22 is a side cross-sectional view of a trigger assembly, valve assembly and bolt for a compressed gas gun of the present invention, showing an alternative preferred valve assembly.
Figure 23:
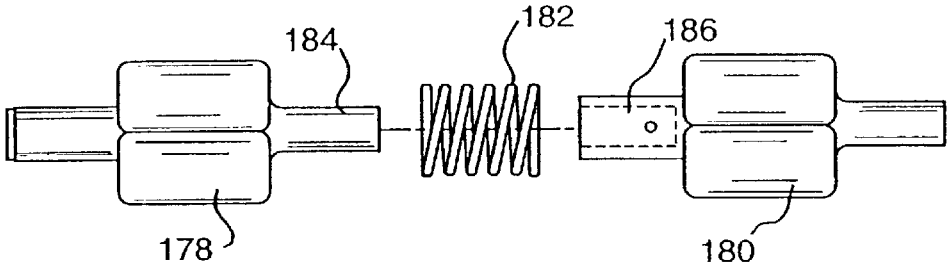
FIG. 23 is an exploded view of a captive assembly of a forward valve poppet, rear valve poppet, and spring for a gas powered gun according to the present invention.

Referring to FIGS. 22 and 23, an improved valve assembly 174 is illustrated. As before, this valve includes a housing 176, a forward valve 178, a rear valve 180, and a spring therebetween 182. The valve assembly 174 is a captive assembly, permitting easy disassembly and reassembly. The front valve 178 and rear valve 180 include mating male and female components 184, 186 forming a telescoping spring guide. As before, moving the valve housing 176 forward with respect to the front valve 178 opens the front valve, and moving the rear valve 180 forward with respect to the housing 176 open the rear valve 180. The spring 182 biases the rear valve 180 and housing 176 rearward, closing both valves.

To use the rifle 10, a gas cartridge 28 is first secured to the compressed gas channel 104. At least one gas cartridge 28 must be used, and more than one may be used. If desired, a pressure gauge 30 may also be connected to the compressed gas channels 104. The gas selected may be either compressed air, or any compressed gas commonly used for air guns. One example is carbon dioxide. Next, projectiles are loaded into the magazine. If a rotary magazine or cylinder 110 is used, any projectile suitable for use in an air gun may be used, including spherical projectiles, conventional pellets, darts, etc. The cylinder 110 is loaded by first depressing the bearing 116 so that it does not block removal of the cylinder 110, and then pushing forward on the reloading tab 130, thereby retracting the pawls end 132 from the chamber. The cylinder 110 is now free to exit the rifle 10. The projectiles are pushed into place through the front portion of the chambers, and secured with friction. After loading all six chambers, the cylinder 110 may be inserted back into place within the rifle 10, after which the shooter re-engages the bearing 116 with the magazine flute 114. If a tubular magazine is used, preferred projectiles include spherical projectiles. These may be loaded by first retracting the follower 142 using a finger tab secured to the follower (not shown and well known in the art), opening the loading gate 144, and pouring spherical projectiles into the magazine tube. Releasing the follower 102 will push the first spherical projectile into the chamber 112 aligned with the tubular magazine 140.

Figure 5:
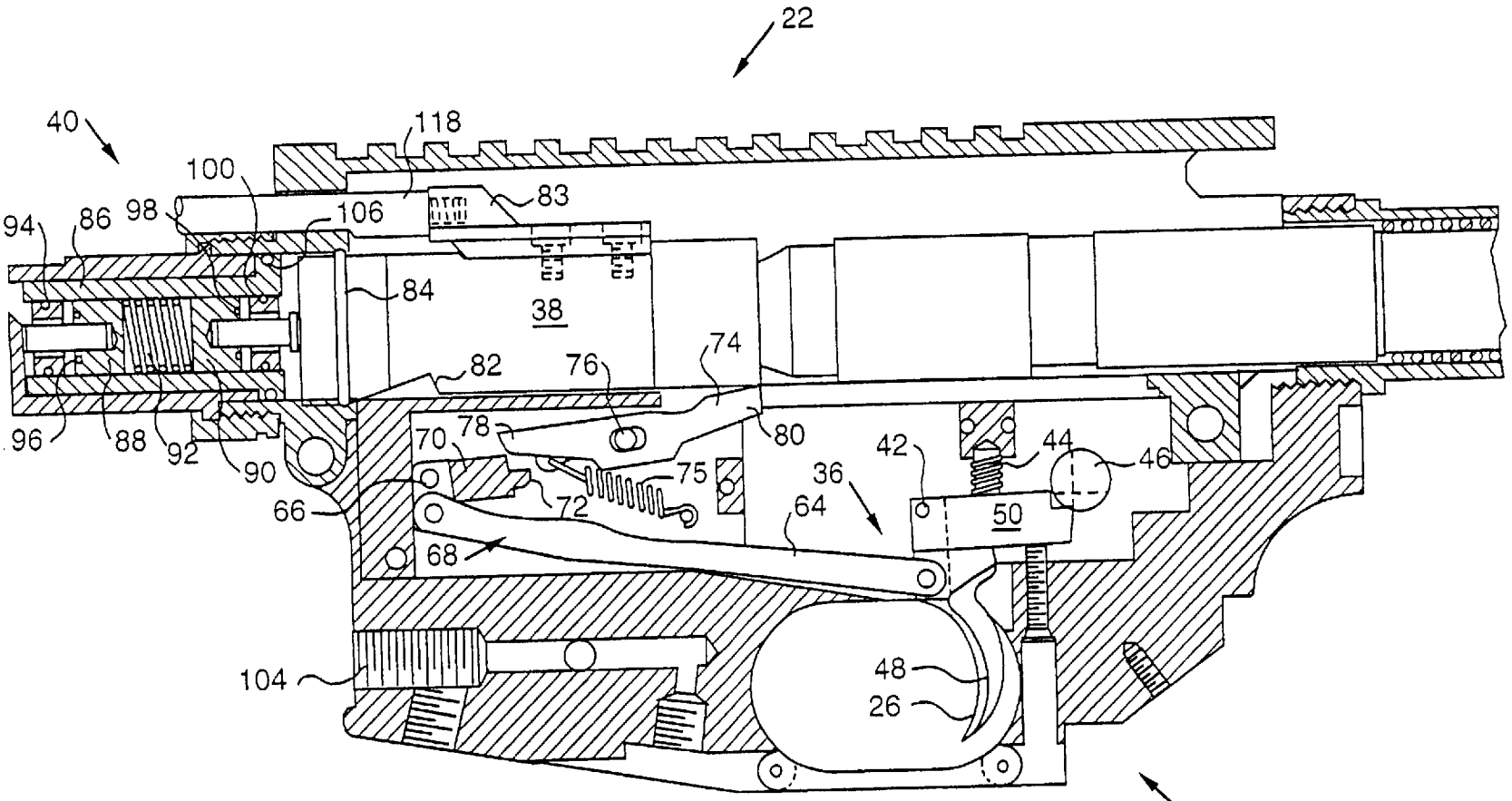
FIG. 5 is a side cross-sectional view of a trigger assembly, valve assembly, and bolt of a gas powered gun according to the present invention, showing the position of the components at the moment of firing.

Compressed air will be supplied from the compressed air container 28, through the compressed air channels 104 and hose 102 to the center portion of the valve assembly 40 between the forward valve 88 and rear valve 90. Before firing, the trigger mechanism 36, valve assembly 40 and bolt 38 are in the positions illustrated in FIG. 4. The bolts 38, although biased forward by pressure from the spring 166, is held in its rear position by the rear end 80 of the sear 74 engaging the notch 82. Pressure from the spring 75 holds the sear 74 in this position, forward pressure from the bolt 38 against the sear 74 pushes the sear towards its forwardmost position on the sliding pivots 76. The trigger spring 44 holds the trigger 26 in its forwardmost position. The selector 46 may be rotated to the appropriate position, corresponding to safe, semi-automatic, or full automatic at a low or high cyclic rate. FIG. 5 depicts the location of the parts when the trigger is pulled in semi-automatic mode. Trigger 26 has been pulled rearward until the selector-engaging portion 50 engages the surface 58 of the selector 46. The trigger bar 64 moves rearward, thereby pivoting the end 68 of the sear's trip 66 upward so that the radiused surface 70 pushes the sear's forward end 78 upward, thereby pivoting the sear's back end 80 downward, releasing the bolt 38 to travel forward. During the forward travel of the bolt 38, the operating rod 118 moves from the rearward position depicted in FIGS. 10 and 13 to the forward position depicted in FIGS. 9 and 14. The pawl carrier 124 is thereby moved from its right side position of FIGS. 10 and 13 to its left side position of FIGS. 9 and 14. The pawl's end 132 is pushed out of the chamber 112 in the one o'clock position when viewed from the rear (FIGS. 10 and 13) to the eleven o'clock position of FIGS. 9 and 14, without rotating the cylinder 110. When the bolt 38 reaches its forwardmost position, air pressure between the bolt 38 and valve housing 86, enhanced by the O-rings 84 and 106, causes the valve housing 86 to move forward, thereby opening the forward valve 88. This releases compressed air to a position immediately behind the projectile in the chamber 112 aligned with the barrel 14, thereby discharging the projectile. At the same time, the bolt 38 strikes the rear valve 90, thereby moving the rear valve 90 forward to open the rear valve 90, thereby releasing compressed air to the bolt 38. The bolt 38 is thereby pushed to its rearward position as the pressure from the compressed air overcomes the bias of the spring 166. At the same time, the operating rod 118 is pulled from its forward position of FIGS. 9 and 14 to its rearward position of FIGS. 10 and 13. The pawl carrier 24 is thereby moved from its left most position to its right most position. As the pawl carrier 124 moves, the surface 134 of the pawl 126 engages the wall of a cylinder 112, thereby pushing the cylinder 110 so that the next chamber 112 is aligned with the barrel 14. The bearing 116 is briefly biased out of the flute 114, engaging the next flute 114 once the appropriate 112 chamber is aligned with the barrel 14. The above portion of the firing sequence, although based on semi-automatic fire, is identical for full automatic fire. The subsequent portion of the firing sequence changes depending on whether semi-automatic or full automatic fire is selected, and the rate of full automatic fire selected.

Figure 6:
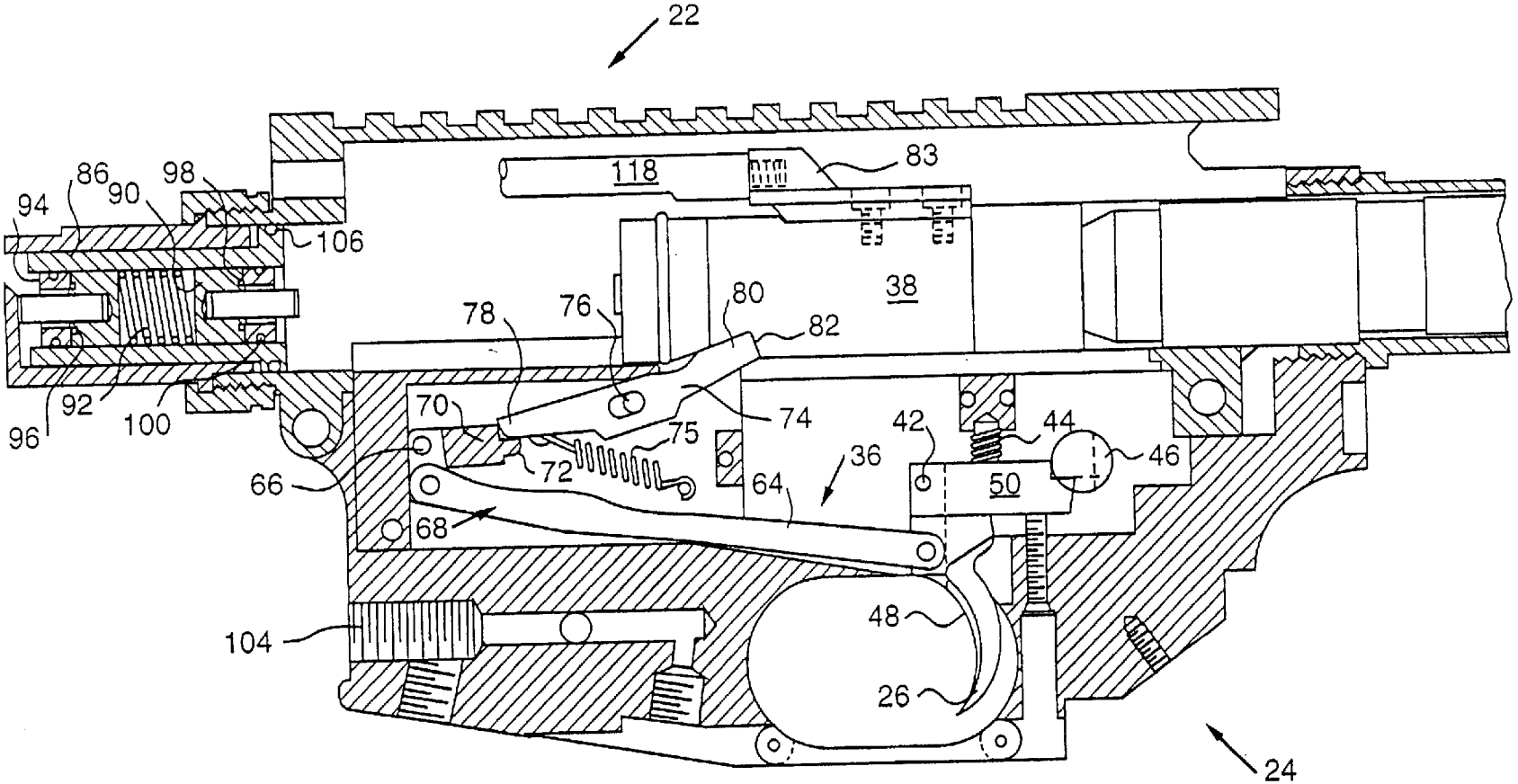
FIG. 6 is a side cross-sectional view of a trigger assembly, valve assembly, and bolt of a gas powered gun according to the present invention, showing the position of the parts after firing and with the trigger still depressed during semi-automatic fire.

FIG. 6 depicts the location of the components after firing a shot in semi-automatic mode, with the trigger still depressed. The spring 75 has pulled the sear 74 to the rear, where the end 78 slips off the radiused surface 70, permitting the sear to rotate so that the rear end 80 rotates upward. The bolt 38 is retracted to a position slightly behind the point where the notch 82 engages the sear 74. As the bolt 38 returns forward under pressure from spring 166, the notch 82 and sear 74 engage each other, thereby arresting forward travel of the bolt 38. At this point, releasing the trigger 26 is necessary to fire another shot.

Figure 7:
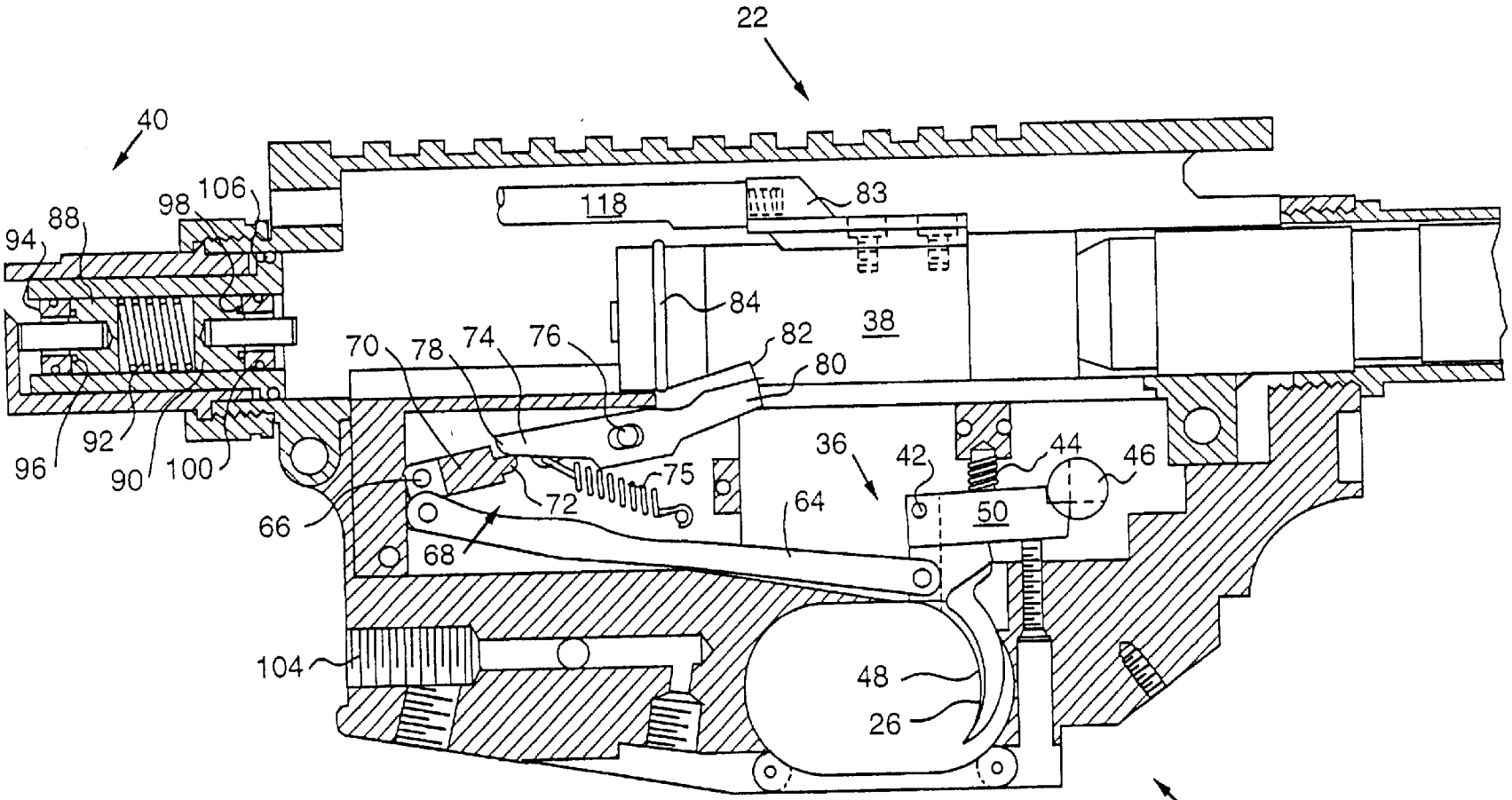
FIG. 7 is a side cross-sectional view of a trigger assembly, valve assembly, a bolt of a gas powered gun according to the present invention, showing the position of the components after the bolt has returned and with the trigger still pulled during full automatic fire at a slow cyclic rate.

FIG. 7 depicts the position of the parts when the rifle 10 is discharged in full automatic mode at a slow rate of fire. In this mode of operation, the selector 46 is rotated so that the surface 60 engages the selector-engaging portion 50 of the trigger 26. The trigger 26 is thereby permitted to move back farther than in semi-automatic mode. As before, gas pressure forces the bolt 38 back to a position slightly behind the point wherein it engages the sear 74. The sear trip 66 is thereby rotated slightly higher, so that the lower radius 72 pushes upward on the front end 78 of the sear 74. The sear is pulled towards its rear most position on the sliding pivot 76 by the spring 75, and is thereby also pulled so that the rear end 80 of the sear 74 is rotated upward. As the bolt 38 returns forward under pressure from spring 166, about $1/32^{nd}$ inch of the rear end 80 of the sear 74 catches the notch 82 of the bolt 38. The floating mass 39, which at this point will be located in the rear portion of the bolts 38, has slowed the bolt 38 sufficiently so that it will momentarily catch on the sear 74. When the bolt 38 engages the sear 74, forward pressure applied to the sear 74 by the bolt 38 will cause the sear 74 to cam off the radiused surface 70 as it moves towards its forwardmost position on the sliding pivot 76, rotating the sear 74 out of the path of the bolt 38. The bolt 38 is then free to travel forward to discharge another shot.

Figure 8:
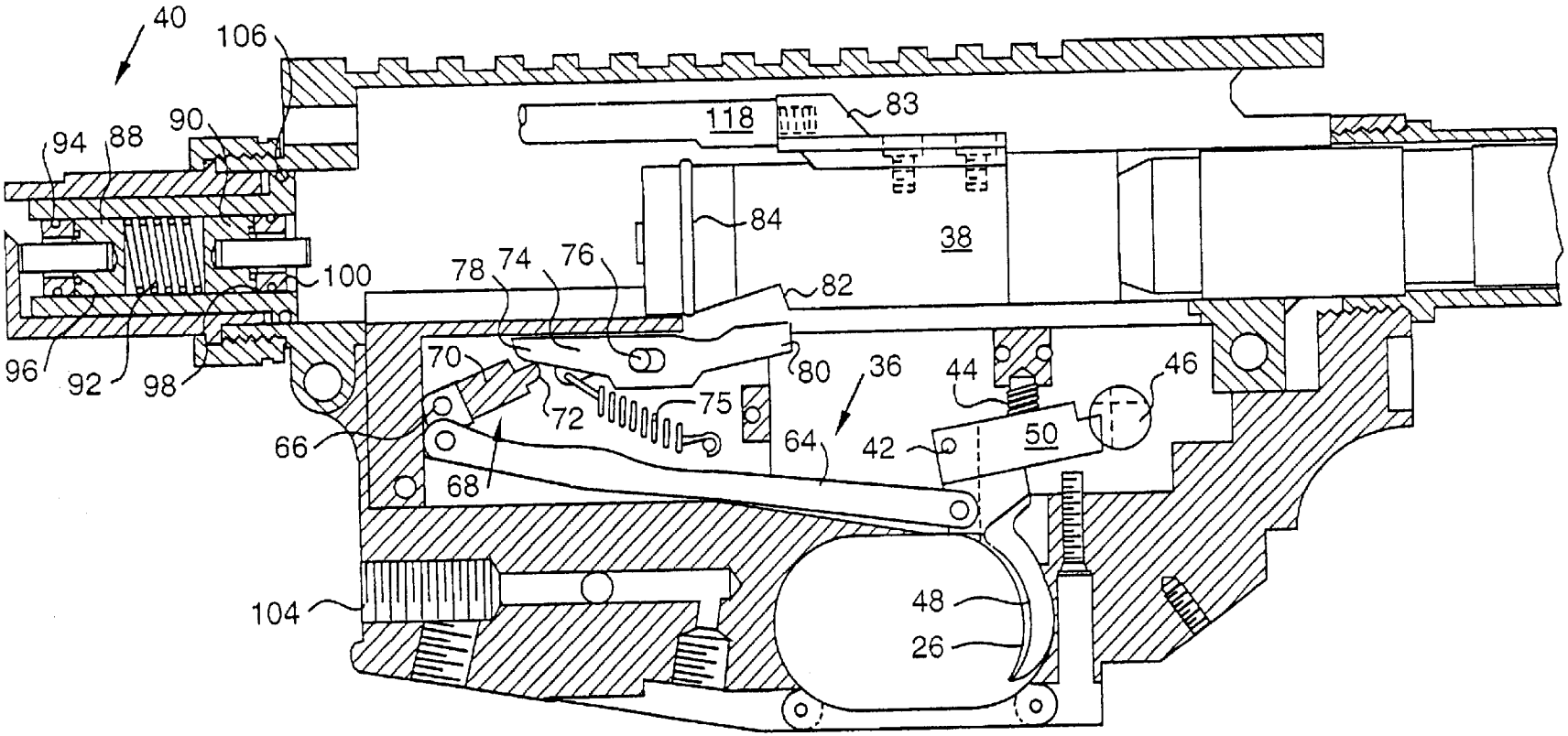
FIG. 8 is a side cross-sectional view of a trigger assembly, valve assembly and bolt of a gas powered gun according to the present invention, showing the position of the components with the bolt retracted and trigger depressed during full automatic fire at a high cyclic rate.
Figure 9:
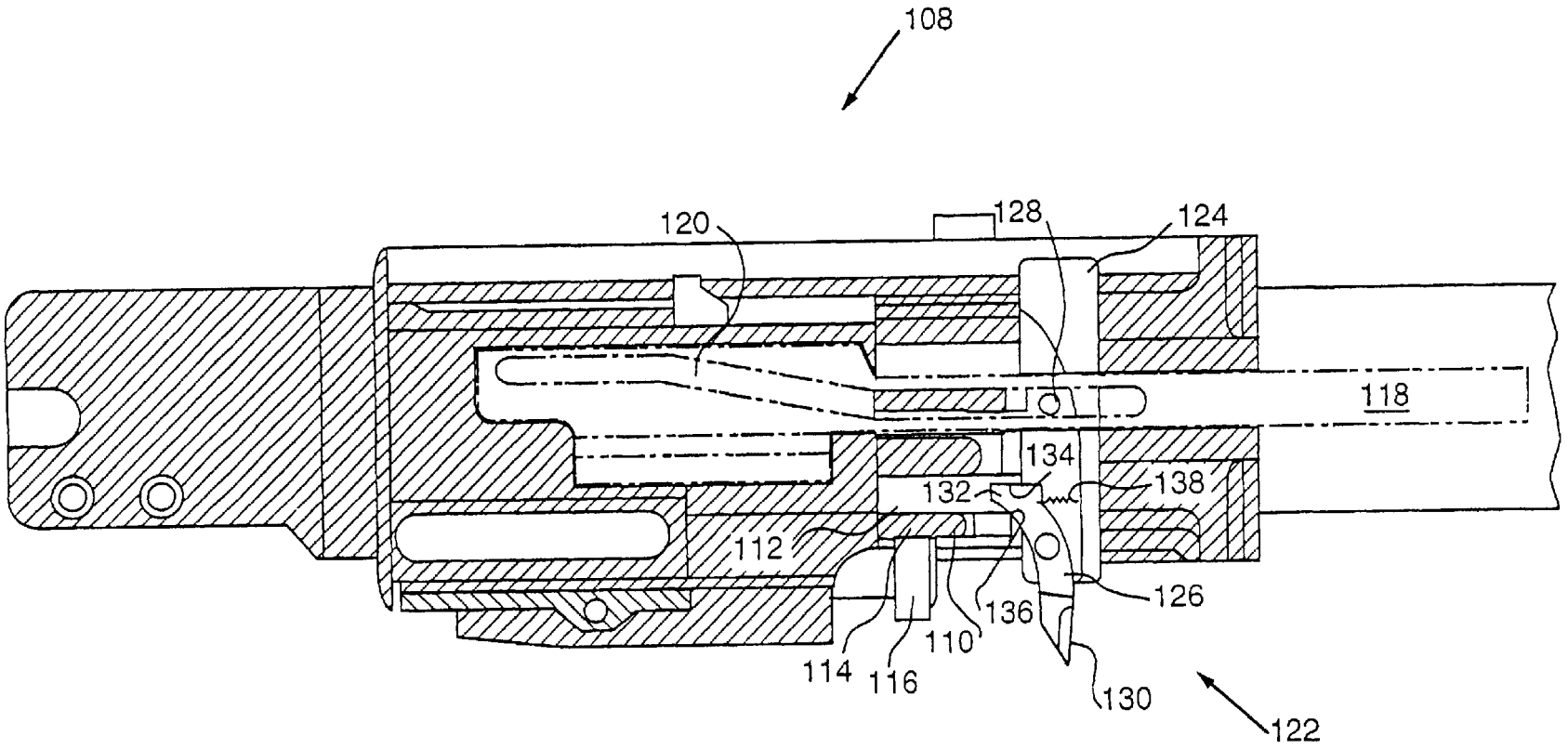
FIG. 9 is a top cross-sectional view of one preferred embodiment of a magazine assembly for a gas powered gun according to the present invention, showing the location of the components when the bolt is in the forward position.
Figure 10:
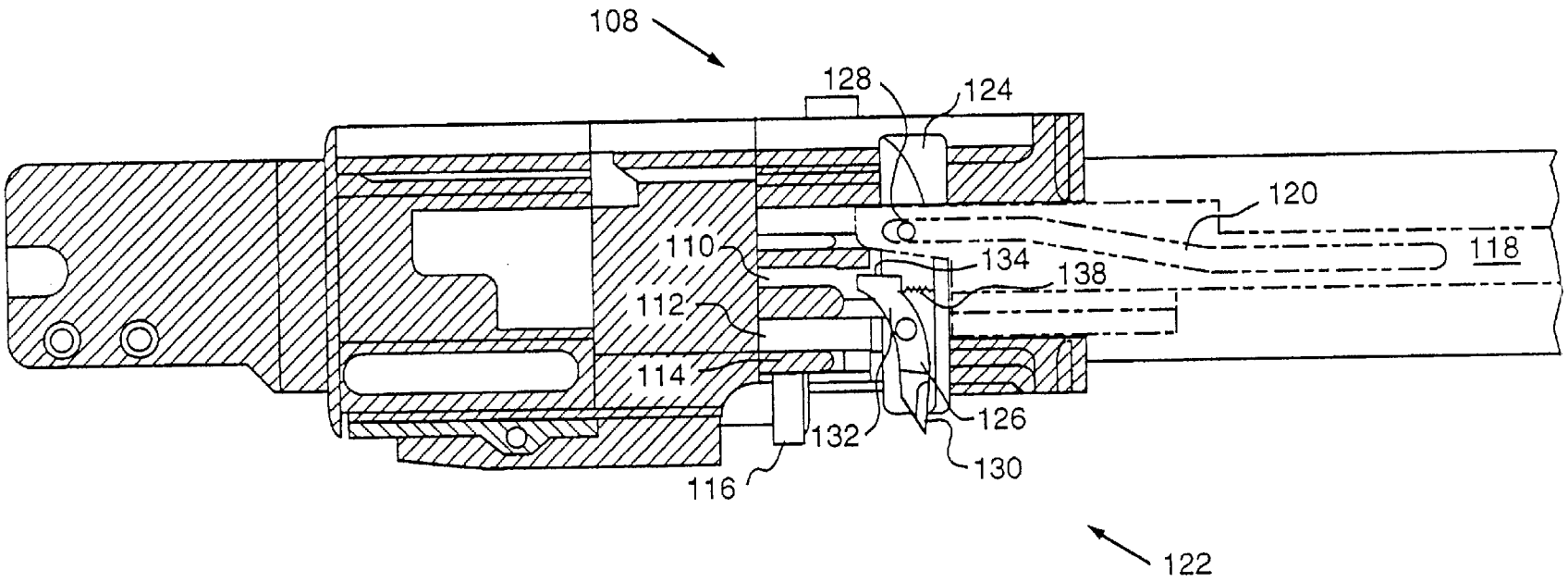
FIG. 10 is a top cross-sectional view of a magazine assembly of FIG. 9 for a gas powered gun according to the present invention, showing the position of the components when the bolt is in the rearward position.
Figure 11:
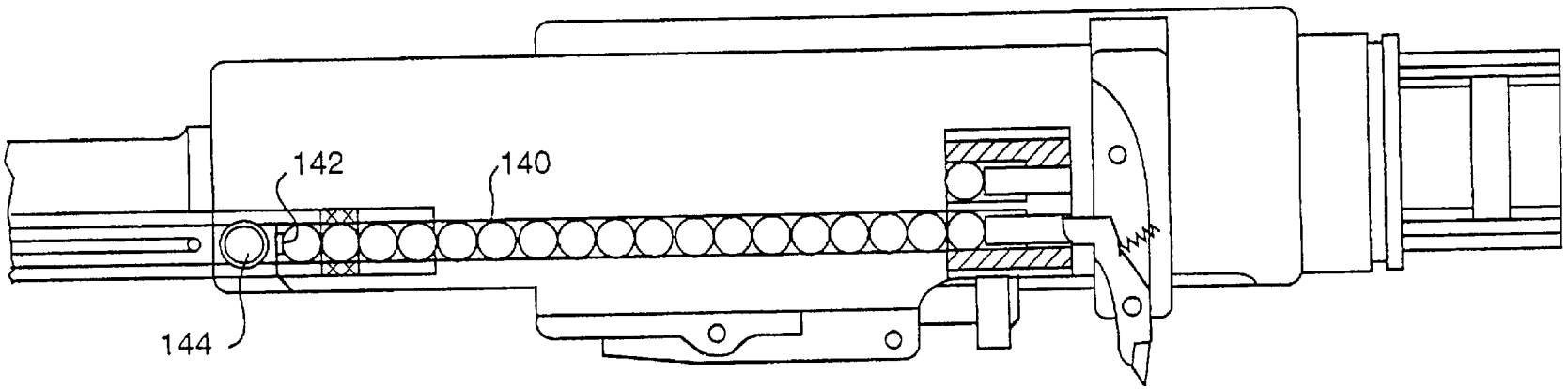
FIG. 11 is a top cross-sectional view of another preferred embodiment of a magazine assembly, with the operating rod deleted for clarity, illustrating the position of the components with the bolt in the forward position.
Figure 12:
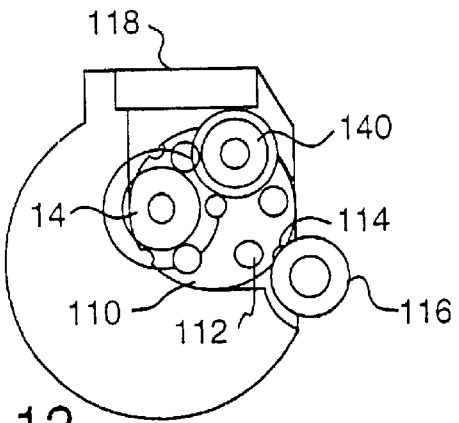
FIG. 12 is a front cross-sectional view of a magazine assembly for a gas-powered gun according to the present invention.
Figure 13:
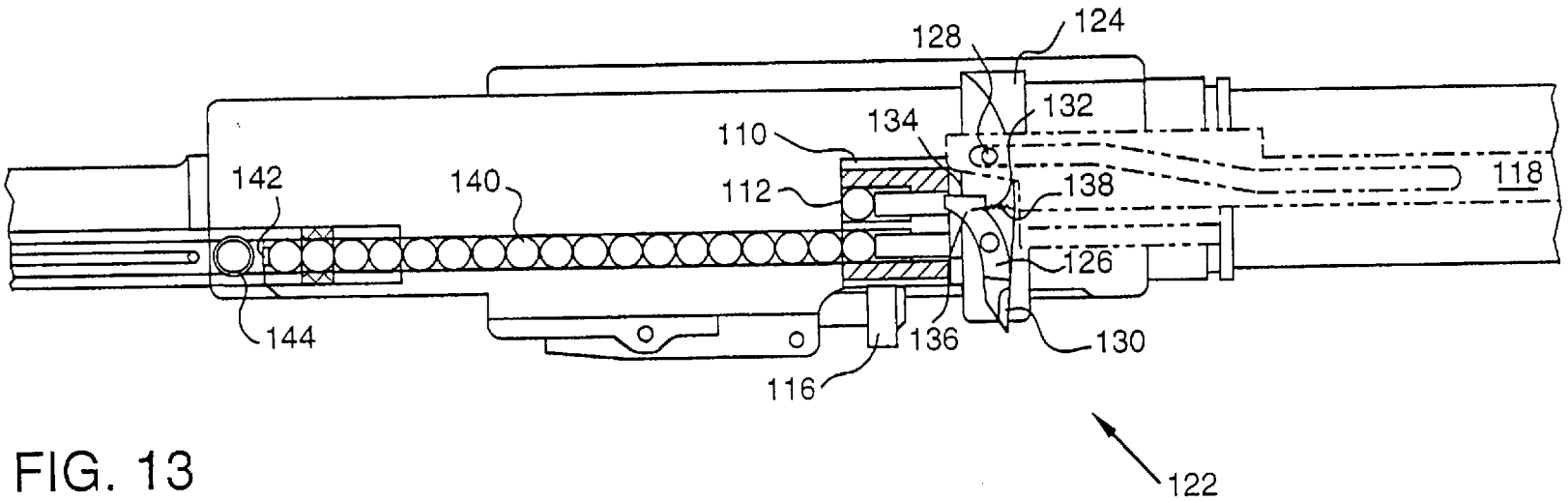
FIG. 13 is a top cross-sectional view of a magazine assembly of FIG. 1, showing the position of the components with the bolt in the rearward position.
Figure 14:
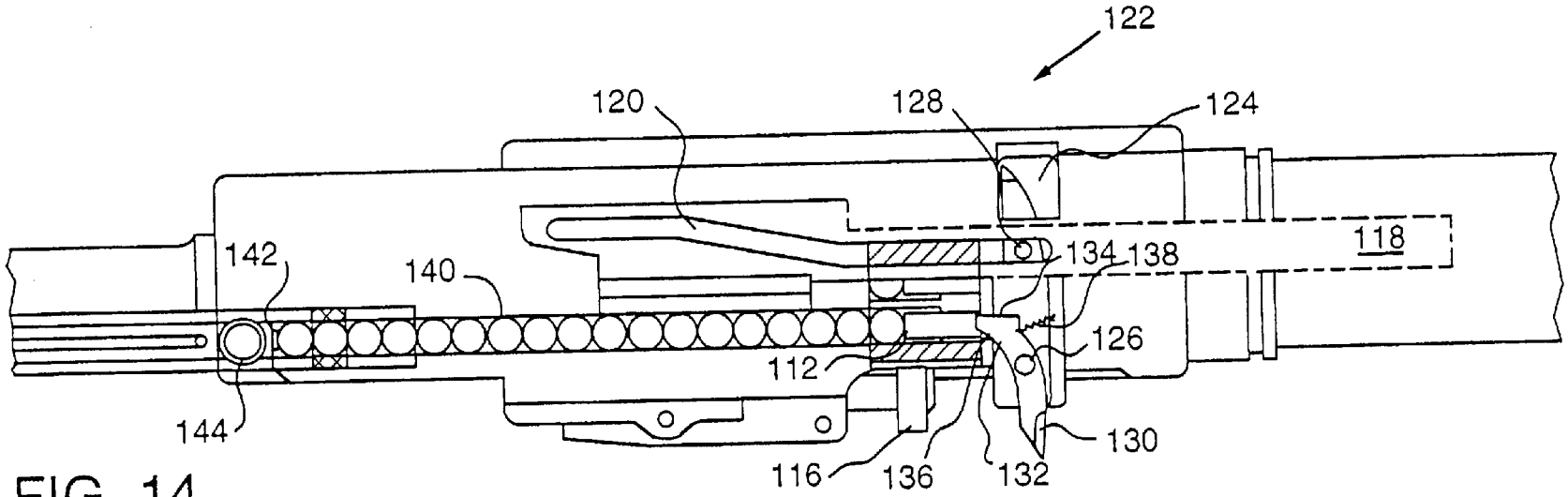
FIG. 14 is a top cross-sectional view of the magazine assembly of FIG. 11, showing the position of the components with the bolt in the forward position.

FIG. 8 depicts the location of the parts if full automatic fire is selected. The selector 46 is rotated so that the selector-engaging portion 50 of the trigger 26 corresponds to the channel 62 within the selector 46, permitting the trigger 26 to travel to its maximum rearward position. The sear trip 66 is thereby rotated to its maximum upward position, thereby rotating the sear 74 completely out of the way of the bolt 38. When the bolt 38 travels rearward sufficiently for the spring 166 to overcome the air pressure from the valve 90, there is nothing to impede the forward motion of the bolt. This results in a maximum cyclic rate.

A typical cyclic rate for full automatic fire with the low cyclic rate is approximately 600 rounds per minute. A typical cyclic rate for a full automatic fire at a high cyclic rate is approximately 900 rounds per minute, approximately simulating the cyclic rate of an M-16 rifle.

Upon reading the above description, it becomes obvious that a magazine 146 may be substituted for the cylinder 110 without changing the basic operation of the rifle 10. As the bolt 38 travels forward, the pawl carrier 124 will move from right to left as before, indexing the pawl 126 from one indexing chamber 150 to the next indexing chamber 150. As the bolt 38 travels rearward, the pawl carrier 124 will move from left to right as before, causing the pawl 126 to index the magazine 146 so that the next firing chamber 148 is aligned with the barrel 14. As before, the bearings 116 will fit within the corresponding flutes 152 to align the chambers 148 precisely with the barrel 14.

The airgun 10 has two accuracy-enhancing features. The combination of the bearing 116 and smaller radius flutes 114 ensures that the chamber 112 of the cylinder 110 aligns with the barrel 14 so precisely that a forcing cone at the breech end of the barrel is not required. This provides a totally straight path for the projectile throughout the chamber 112 and barrel 14. Additionally, as compressed gas pressure from the container 28 decreases, the bolt 38 will push the valve 90 further inward as it strikes the valve 90, thereby increasing the gas flow within the valve assembly 40. This ensures that each projectile will have a substantially consistent velocity. Therefore, the projectile will have a substantially consistent energy and trajectory.

While a specific embodiment of the invention has been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalence thereof.

What is claimed is:

1. A magazine assembly for a gas-powered gun, comprising:

a cylinder-type magazine having a plurality of chambers, each of said chambers being dimensioned and configured to be axially aligned with a barrel, and to receive a projectile therewithin;

means for automatically indexing said magazine upon the cycling of a bolt, comprising:

a pawl carrier reciprocating between a first side position and a second side position; and a pawl dimensioned and configured to engage one of said chambers when said pawl carrier is in said first side position, and one of said chambers when said pawl carrier is in said second side position, said pawl being biased towards said magazine;

means for automatically aligning one of said chambers with said barrel upon completion of indexing; and a magazine tube dimensioned and configured to align with one of said magazine's chambers and to contain projectiles, said magazine tube containing a spring-biased follower.

2. The magazine assembly according to claim 1, wherein said pawl comprises:

a pusher surface dimensioned and configured to index said magazine when said pawl carrier moves from said first side position to said second side position; and a ramped surface dimensioned and configured to permit said pawl to exit one of said chambers when said pawl carrier moves from said second side position to said first side position, and to engage another of said chambers when said pawl carrier reaches said first side position.

3. The magazine assembly according to claim 1, further comprising an operating rod secured to a bolt, said bolt reciprocating between a forward position and a rear position, said operating rod being dimensioned and configured to cycle said pawl carrier upon the cycling of said bolt.

4. The magazine assembly according to claim 3, wherein said operating rod is dimensioned and configured to move said pawl carrier from said second position to said first position when said bolt moves towards its forward position, and to move said pawl carrier from said first position to said second position when said bolt moves towards its rear position.

5. The magazine assembly according to claim 4, wherein:

said operating rod comprises a slot, said slot being angled relative to a direction of travel of said bolt; and said pawl carrier includes a pin dimensioned and configured to engage said slot in said operating rod.

6. A magazine assembly for a gas-powered gun, comprising:

a magazine having a plurality of chambers, each of said chambers being dimensioned and configured to be axially aligned with a barrel, and to receive a projectile therewithin, said magazine includes an exterior surface having a plurality of flutes, with each of said flutes corresponding to one of said chambers;

means for automatically indexing said magazine upon the cycling of a bolt; and means for automatically aligning one of said chambers with said barrel upon completion of indexing comprising a spring-biased bearing dimensioned and configured to engage one of said plurality of flutes.

7. The magazine assembly according to claim 6, wherein said bearing has a radius larger than a radius of each of said flutes.

8. A magazine assembly for a gas-powered gun, comprising:

a magazine having the form of an elongated sliding member, the magazine having a plurality of chambers, each of said chambers being dimensioned and configured to be axially aligned with a barrel, and to receive a projectile therewithin, the magazine further having a plurality of indexing chambers;

means for automatically indexing said magazine upon the cycling of a bolt, comprising:

a pawl carrier reciprocating between a first side position and a second side position; and a pawl dimensioned and configured to engage one of said indexing chambers when said pawl carrier is in said first side position, and one of said indexing chambers when said pawl carrier is in said second side position, said pawl being biased towards said magazine; and means for automatically aligning one of said chambers with said barrel upon completion of indexing.

9. The magazine assembly according to claim 8, wherein said pawl comprises:

a pusher surface dimensioned and configured to index said magazine when said pawl carrier moves from said first side position to said second side position; and a ramped surface dimensioned and configured to permit said pawl to exit one of said indexing chambers when said pawl carrier moves from said second side position to said first side position, and to engage another of said indexing chambers when said pawl carrier reaches said first side position.

10. The magazine assembly according to claim 9, further comprising an operating rod secured to a bolt, said bolt reciprocating between a forward position and a rear position, said operating rod being dimensioned and configured to cycle said pawl carrier upon the cycling of said bolt.

11. The magazine assembly according to claim 10, wherein said operating rod is dimensioned and configured to move said pawl carrier from said second position to said first position when said bolt moves towards its forward position, and to move said pawl carrier from said first position to said second position when said bolt moves towards its rear position.

12. The magazine assembly according to claim 11, wherein:

said operating rod comprises a slot, said slot being angled relative to a direction of travel of said bolt; and said pawl carrier includes a pin dimensioned and configured to engage said slot in said operating rod.

13. A magazine assembly for a gas-powered gun, comprising:

a cylinder-type magazine having a plurality of chambers, each of said chambers being dimensioned and configured to be axially aligned with a barrel, and to receive a projectile therewithin;

means for automatically indexing said magazine upon the cycling of a bolt, comprising:

a pawl carrier reciprocating between a first side position and a second side position; and a pawl dimensioned and configured to engage one of said chambers when said pawl carrier is in said first side position, and one of said chambers when said pawl carrier is in said second side position, said pawl being biased towards said magazine; and means for automatically aligning one of said chambers with said barrel upon completion of indexing.

14. The magazine assembly according to claim 13, wherein said pawl comprises:

a pusher surface dimensioned and configured to index said magazine when said pawl carrier moves from said first side position to said second side position; and a ramped surface dimensioned and configured to permit said pawl to exit one of said chambers when said pawl carrier moves from said second side position to said first side position, and to engage another of said chambers when said pawl carrier reaches said first side position.

15. The magazine assembly according to claim 13, further comprising an operating rod secured to a bolt, said bolt reciprocating between a forward position and a rear position, said operating rod being dimensioned and configured to cycle said pawl carrier upon the cycling of said bolt.

16. The magazine assembly according to claim 15, wherein said operating rod is dimensioned and configured to move said pawl carrier from said second position to said first position when said bolt moves towards its forward position, and to move said pawl carrier from said first position to said second position when said bolt moves towards its rear position.

* * * * *